United States Patent [19]

Moeser

[11] 4,122,571

[45] Oct. 31, 1978

[54] BOAT SEAT LATCHING ASSEMBLY

[75] Inventor: Denis S. Moeser, Clayton, Mo.

[73] Assignee: Leisure Products, Inc., St. Louis, Mo.

[21] Appl. No.: 814,680

[22] Filed: Jul. 11, 1977

[51] Int. Cl.[2] ..... B63B 29/00

[52] U.S. Cl. ..... 9/7; 114/194; 248/503.1; 297/349

[58] Field of Search ..... 9/7; 114/194; 297/250–253, 256.69, 240, 349, 353, 376; 248/2, 19, 25, 154, 225.3, 226, 305, 313, 316 R, 316 A, 500, 502, 503, 503.1, 506, 429, 430, 510; 180/68.5

[56] References Cited

U.S. PATENT DOCUMENTS

| | | | |
|---|---|---|---|
| 2,063,674 | 12/1936 | Hendrickson et al. | 297/349 |
| 2,675,986 | 4/1954 | Fisher | 248/25 |
| 3,821,825 | 7/1974 | Bailey | 9/7 |

*Primary Examiner*—Trygve M. Blix
*Assistant Examiner*—Jesus D. Sotelo
*Attorney, Agent, or Firm*—Koenig, Senniger, Powers and Leavitt

[57] ABSTRACT

A latching assembly for mounting a seat on a boat thwart or the like comprising a base to rest on top of the thwart for securement of a seat thereto. A pair of keepers are mounted on top of the thwart for securing opposite sides of the base to the thwart, and a latch is mounted on the base on one of the opposite sides of the base. The latch is selectively movable from a retracted position to an extended latching position in which the latch projects beyond the side of the base and underlies one keeper to prevent vertical movement of the base relative to the thwart. The latch also abuts that keeper to block movement of the base on the thwart in side-to-side, front-to-back and back-to-front directions when the latch is in its latching position.

21 Claims, 9 Drawing Figures

BOAT SEAT LATCHING ASSEMBLY

BACKGROUND OF THE INVENTION

This invention relates generally to means for mounting a seat and in particular to a boat seat mounting assembly adapted to be latched onto a boat thwart.

On smaller boats, such as for instance, a johnboat or other fishing or game type boats, thwarts serve not only for structural support between the gunwales but also as seats for the boatman and passengers. Inasmuch as a thwart seat does not provide any back support, however, it is oftentimes desirable to mount a seat such as a plastic or fiber glass molded contour seat (often referred to as a "legless chair") on the thwart. It is also frequently advantageous that the seat be readily mountable and demountable from a thwart rather than being permanently attached thereto so that the seat may be safely stored when not in use. Moreover, with the seat removed, the boat may be more readily transported in inverted position on the top of a car or stacked with other boats in nested fashion.

Boat seat mounting assemblies of the latching type for detachably mounting a boat seat on a boat thwart have been known in the past as shown on page 27 of the 1977 Sears, Roebuck and Co. catalogue entitled 'Boating and Fishing'. Heretofore, however, detachable mounting units of this type have presented certain problems, one being that they did not mount the boat seat on the thwart with sufficient rigidity to withstand constant jolting movements of a person in the seat. Moreover, many of these prior art units were not of durable construction.

SUMMARY OF THE INVENTION

Among the several objects of this invention may be noted the provision of an improved detachable boat seat mounting assembly which rigidly mounts the boat seat on a thwart; the provision of such an assembly which allows a seat to be readily mounted on and demounted from a boat thwart; the provision of such an assembly which is adapted to be quickly and easily installed on the thwart of a boat without substantial modifications or damage to the thwart; and the provision of an improved mounting unit which is simple and economical in construction yet durable.

In general, a latching assembly of this invention for rigidly mounting a seat on a boat thwart or the like comprises a base adapted to rest on top of the thwart and to have the seat secured thereto, a pair of keepers mounted on top of the thwart for securing opposite sides of the base to the thwart and at least one latch mounted on one of the aforesaid opposite sides of the base. The latch is selectively movable from a retracted position to an extended latching position in which the latch projects beyond the side of the base and underlies one keeper to prevent vertical movement of the base relative to the thwart. Means for locking the latch in its latching position are also included. The end of the latch abuts the respective keeper to block side-to-side movement of the base on the thwart when the latch is locked in its latching position, and the sides of the latch abut the keeper to block movement of the base on the thwart in a front-to-back and back-to-front direction when the latch is in its latching position. Other objects and features will be in part apparent and in part pointed out hereinafter.

Other objects and features will be in part apparent and in part pointed out hereinafter.

DESCRIPTION OF A PREFERRED EMBODIMENT

Figure 1:
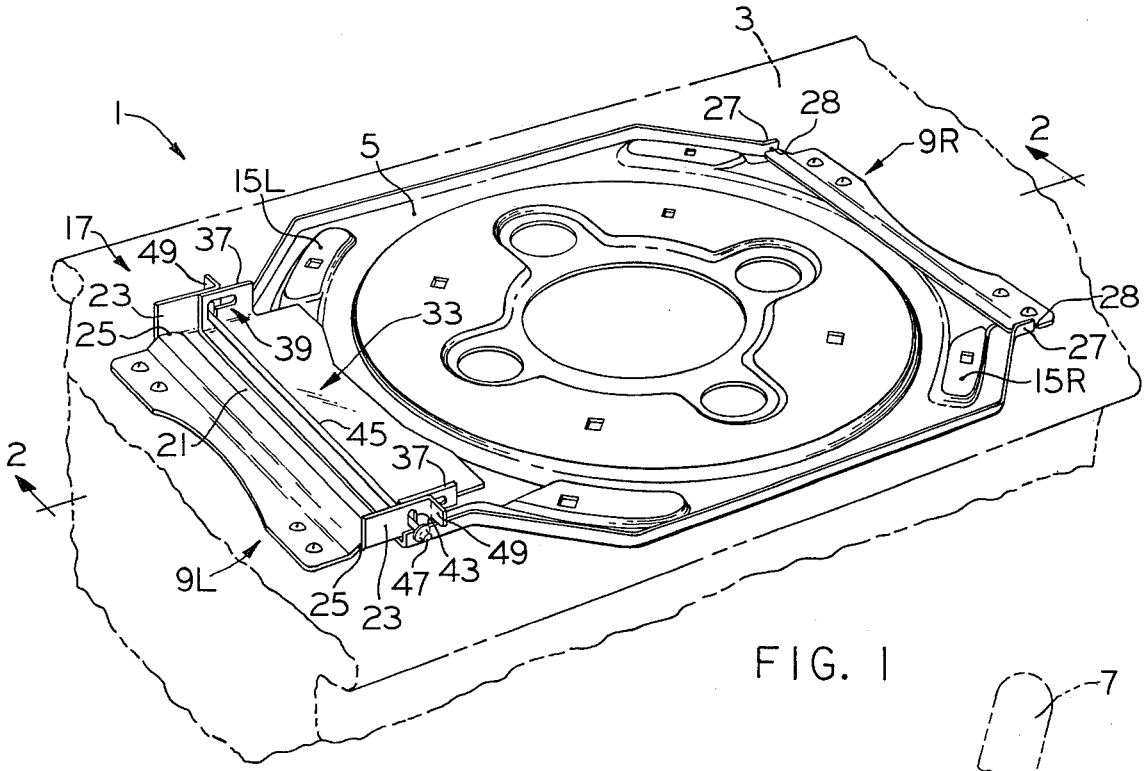
FIG. 1 is a perspective showing a boat seat latching assembly of this invention mounted on a boat thwart, the latter being shown in phantom.
Figure 2:
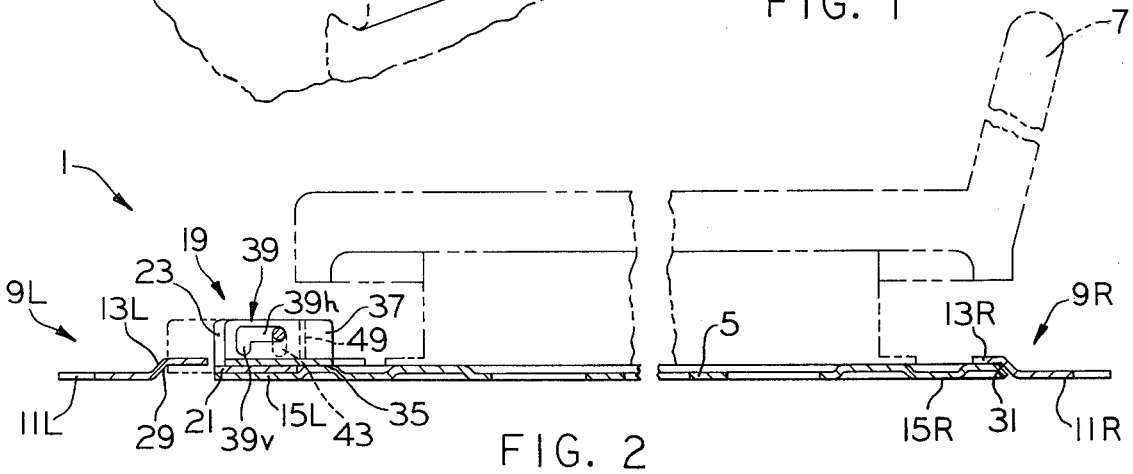
FIG. 2 is a section on line 2—2 of FIG. 1.
Figure 3:
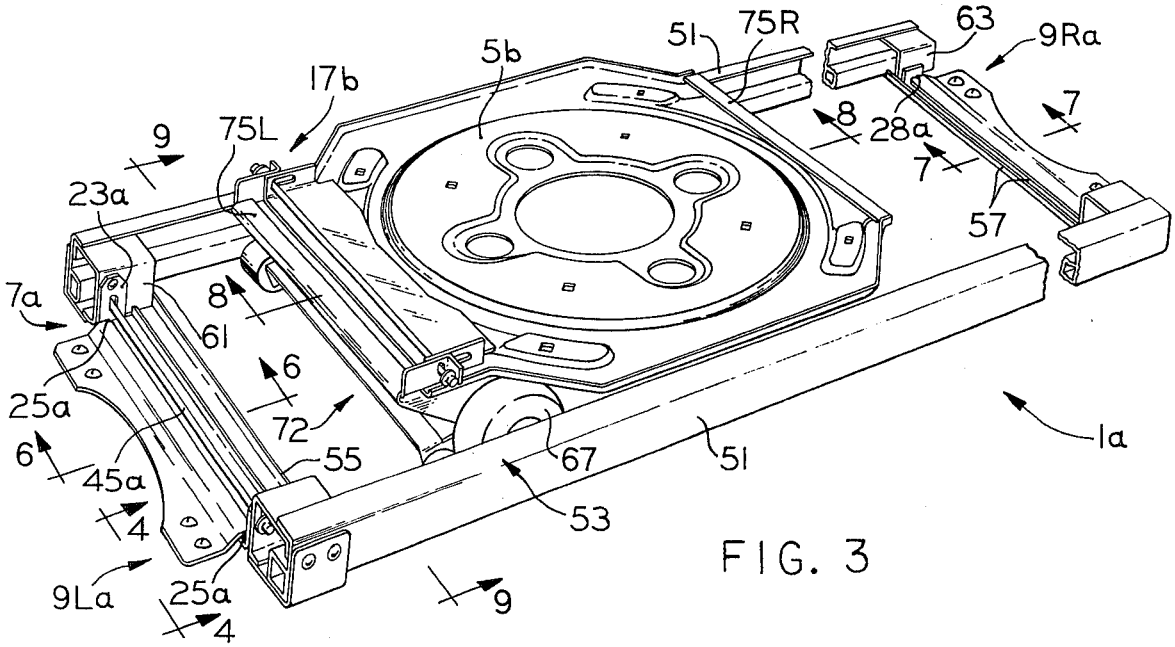
FIG. 3 is a perspective showing an alternative latching assembly having a base comprising a pair of guide rails and a carriage reciprocally movable on the thwart between the rails.
Figure 4:
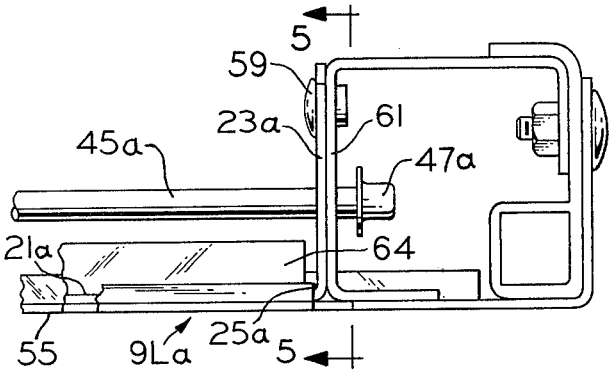
FIG. 4 is a section on line 4—4 of FIG. 3.
Figure 5:
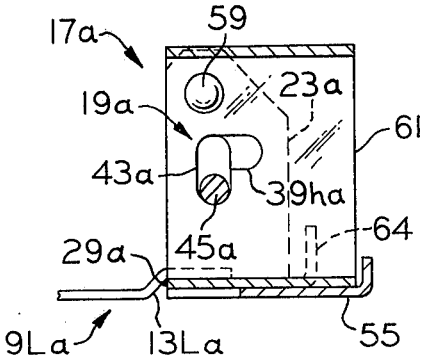
FIG. 5 is a section on line 5—5 of FIG. 4 showing a latch of the alternative latching assembly in a latching position.
Figure 6:
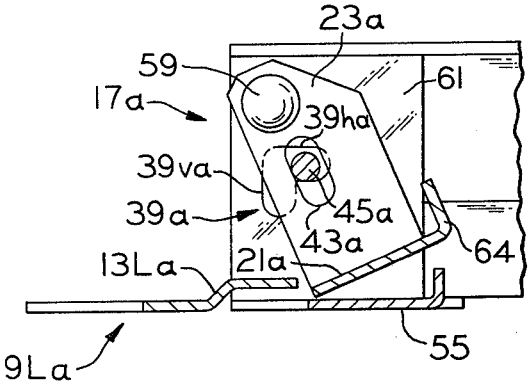
FIG. 6 is a section on line 6—6 of FIG. 3 showing the latch of the alternative latching assembly in a retracted position.
Figure 7:
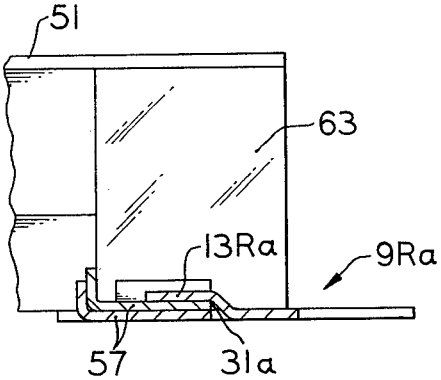
FIG. 7 is a section on line 7—7 of FIG. 3.
Figure 8:
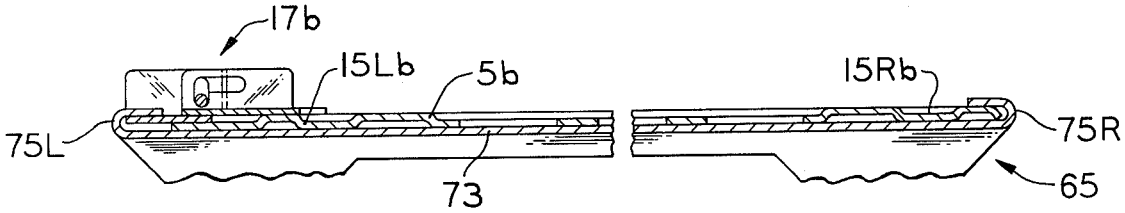
FIG. 8 is a section on line 8—8 of FIG. 3 showing a modification of the boat seat latching assembly of FIG. 1.

Referring now to FIGS. 1 and 2 of the drawings, a boat seat latching assembly of this invention is indicated generally at 1 and is shown mounted on a bench-type structure, such as a thwart 3 of a boat. This assembly includes a base in the form of a relatively flat mounting plate 5 which rests atop the thwart and on which a contoured swivel seat 7 may be secured, and a pair of keepers, the left keeper (as viewed in FIGS. 1 and 2) being indicated generally at 9L and the right keeper generally at 9R. These keepers, which generally comprise elongate plates 11L, 11R having upwardly offset end margins 13L, 13R and which are secured to the thwart by screws or other suitable fasteners, are mounted on the upper surface of the thwart 3 for securing the left and right sides 15L, 15R of the mounting plate 5 to the thwart. A latch generally designated 17 is mounted on the left side 15L of mounting plate 5 and is slidable to the left on the plate from a retracted position (FIG. 2) to an extended latching position (FIG. 1) in which the latch projects beyond the left side 15L of the plate and underlies left keeper 9L. With the latch in this position and the right side 15R of plate 5 beneath right keeper 9R, the plate and swivel seat 7 thereon are rigidly mounted atop the thwart. Generally indicated at 19 is means for automatically locking latch 17 in its latching position. It will be understood that a separate latch could be provided at right side 15R of plate 5 for selective engagement with right keeper 9R (in lieu of right side 15R underlying the mounting plate) without departing from the scope of this invention.

As illustrated, latch 17 is generally channel-shaped, having a long flat midportion 21 extending substantially along the entire left side 15L of the mounting plate 5 and integrally formed flanges 23 at each side of midportion 21. It should be understood, however, that two or more separate, relatively short latches could be used instead of the long single latch 17 herein disclosed. Flanges 23 extend upwardly at opposite sides of the left keeper 9L and abut the sides of that keeper at 25 (see FIG. 1) when latch 17 is in its latching position (i.e., when latch midportion 21 underlies end margin 13L of keeper 9L). Thus, these flanges 23 constitute abutment means for blocking plate 5 at its left side 15L from moving either forward or aft on the thwart. For blocking plate 5 at its right side 15R from slipping either forward or aft, the plate has upturned edges or side walls 27 which abut opposite sides of the right keeper 9R at 28 when the right side 15R of the mounting plate underlies that keeper. Side-to-side movement of plate 5 on thwart 3 is also prevented when latch 17 is locked in its latching position by abutment at 29 of latch midportion 21 against end margin 13L of left keeper 9L and abutment at 31 of right side 15R of plate 5 against end margin 13R of right keeper 9R (see FIG. 2).

From the foregoing, it is apparent that with the right side 15R of mounting plate beneath the respective keeper 9R and latch 17 in its latching position underlying left keeper 9L, movement of plate 5 on the thwart in vertical, side-to-side, front-to-back and back-to-front directions is entirely precluded and the plte 5 and seat 7 thereon securely mounted atop the thwart.

Means 19 for locking latch 17 in a latching position includes a U-shaped member, generally designated 33, overlying the latch and rigidly joined along its right end to plate 5 as indicated at 35 in FIG. 2. This member 33 has side walls 37 extending along the inside of and parallel to latch flanges 23, the latter having a pin-and-slot connection with side walls 37 for slidaly mounting latch 17 on plate 5. More particularly, each side wall 37 has a slot therein, generally designated 39, having horizontal and vertical portions 39*h* and 39*v*, respectively. Each flange 23 also has an opening 43 therein generally corresponding in dimension to the vertical portion 39*v* of the slot in the adjacent side wall 37. As best illustrated in FIG. 1, a pin means comprising a rod 45 extends between flanges 23 and through slots 39 and openings 43, the rod being maintained in position by a cap 47 at each of its ends.

As latch 17 is slid from its retracted position (shown in solid lines in FIG. 2) to its latching position (shown in phantom), rod 45 moves in horizontal portions 39*h* of slots 39 until flange openings 43 move into alignment with vertical portions 39*v* of slots 39 whereupon rod 45 drops down in the aligned slots and openings thereby automatically to lock the latch in its latching position. The latch may be returned to a retracted position (so that the plate 5 and swivel seat 7 thereon may be removed from the thwart and conveniently transported or stored) simply by pulling rod 45 upwardly and then sliding latch 17 to the right until clear of left keeper 9L. Finger tabs 49 project outwardly from flanges 23 of latch 17 for sliding the latch between its retracted and latching positions.

It will be apparent from the foregoing that plate 5 and swivel seat 7 thereon may be readily mounted on and demounted from boat thwart 3 by appropriate manipulation of latch 17. Moreover, the latching assembly 1 of this invention can be quickly and easily installed on a boat thwart without substantial modification or damage to the thwart inasmuch as keepers 9 may suitably be secured to the thwart by only a few screws or the like.

Referring now to FIGS. 3–8, another latching assembly of this invention is indicated generally at 1*a*. The base of this assembly is shown to comprise a pair of parallel guide rails 51 and a carriage generally designated 53 reciprocally movable on the thwart (not shown) between the rails. As shown, guide rails 51 are connected at their left ends by a cross brace 55 and at their right ends by a pair of stacked cross braces 57. Assembly 1*a* further includes two keepers generally designated 9L*a* and 9R*a* (identical to keepers 9L and 9R described above), mounted on the upper surface of the thwart for securing opposite ends of guide rails 51 thereto. In this embodiment, a latch generally designated 17*a* is swingably mounted between guide rails 51 at the left ends thereof above cross brace 55 for swinging about a horizontal axis between a retracted (FIG. 6) and an extended latching position (FIG. 5) in which latch 17*a* overlies cross brace 55 and snugly fits beneath left keeper 9L*a*. With latch 17*a* in this position and cross braces 57 underlying the right keeper 9R*a* (FIG. 7), guide rails 51 and carriage 53 thereon are securely mounted on the thwart. Means generally indicated at 19*a* is also provided for automatically locking latch 17*a* in its latching position.

Figure 9:
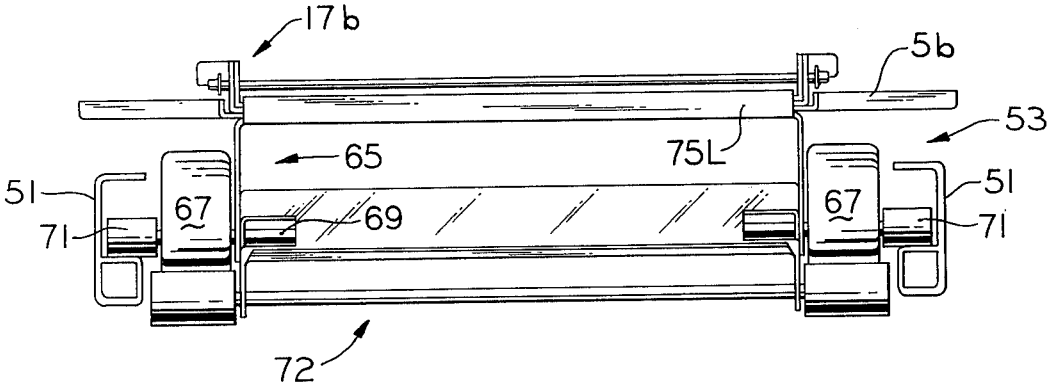
FIG. 9 is a section on line 9—9 of FIG. 3.

Latch 17*a*, which is generally of channel-shape, comprises a long flat midportion 21*a* and two flanges 23*a* at opposite ends of the midportion. These flanges are pivoted at their upper ends at 59 to opposing side walls 61 of guide rails 51, each of which is generally in the form of a rectangular tube at its outer ends and of the cross section shown in FIG. 9 therebetween. When latch 17*a* is in its latching position, flanges 23*a* extend upwardly at opposite sides of left keeper 9L*a* and abut the sides of that keeper at 25*a* (FIG. 3) to block rails 51 at the left ends thereof from moving either forward or aft on the thwart. Similarly, with cross braces 57 underlying the right keeper 9R*a*, opposed side walls 63 extend upwardly at opposite sides of that keeper and abut it at 28*a* to block rails 51 at the right ends thereof from moving either in front-to-back or back-to-front directions on the thwart. Side-to-side movement of the rails is also precluded when the latch is locked in its latching position by abutment at 29*a* of latch midportion 21*a* against end margin 13L*a* of left keeper 9L*a* and the abutment at 31*a* of cross braces 57 against end margin 13R*a* of right keeper 9R*a*.

Thus, with cross braces 57 beneath the right keeper 9R*a* and latch 17*a* locked in its latching position, guide rails 51 and carriage 53 thereon are rigidly secured to the thwart.

Means 19*a* for locking latch 17*a* in a latching position is shown in FIGS. 3–6 to comprise a pin-and-slot connection between latch flanges 23*a* and opposing side walls 61 of guide rails 51. More particularly, each side wall 61 has a slot therein, generally designated at 39*a*, having horizontal and vertical portions 39*ha* and 39*va*, respectively. Each latch flange 23*a* also has an opening 43*a* therein generally corresponding in dimension to the vertical portion 39*va* of slot 39*a* in the adjacent side wall 61. A pin means constituted by a rod 45*a* extends between flanges 23*a* and through slots 39*a* and openings 43*a*, rod 45*a* having a cap 47*a* at each of its ends for preventing displacement of the rod from the slots and openings.

As latch 17*a* is swung about pivots 59 by means of a finger grip 64 from a retracted position (FIG. 6) to a latching position (FIG. 5), rod 45*a* moves in the horizontal portions 39*ha* of slots 39*a* until flange openings 43*a* move into alignment with the vertical portions 39*va* of slots 39*a* whereupon rod 45*a* falls down in the aligned slots and openings thereby automatically to lock the latch in its latching position. The latch may be returned to a retracted position simply by pulling rod 45*a* up and then swinging latch 17*a* to the right until clear of left keeper 9L*a*, at which time the entire latching assembly 1*a* (including guide rails 51 and carriage 53) may be quickly and easily removed from the thwart for transport or storage.

Carriage 53 comprises a frame generally designated 65 and two pairs of wheels 67 (only one pair is shown) rotatably received on axles 69 carried by the frame. Cylindrical thrust rollers 71 are mounted on opposite ends of each axle 69 for maintaining the carriage in proper alignment between guide rails 51. These rollers 71 do not, however, carry the weight of carriage 53 which is supported on the thwart entirely by wheels 67.

Releasable locking means generally indicated at 72 is provided for selectively preventing the carriage from rolling to the left along the thwart. Although not shown, an identical locking means is also provided at the opposite side of carriage 53 to prevent it from rolling to the right. Reference can be made to applicant's U.S. Pat. No. 3,891,269 for a further description of locking means 72 and other details of the carriage.

A mounting plate **5*b* identical to the plate 5 described previously, is releasably mounted on carriage 53. To secure opposite sides of the plate 5*b* to the carriage, the carriage frame 65 includes an upper seat support 73 having left and right bent-over side margins 75L, 75R serving the same function as the keepers 9 previously described. More specifically, right side margin 75R overlies the right side 15R*b* of plate 5*b* and left side margin 75L overlies latch 17*b* (which is the same in structure and operation as latch 17 described above) at the left side 15L*b* of the plate when the latch is in a latching position (FIG. 8) thereby rigidly securing plate 5*b* and a swivel seat thereon atop the carriage 53**.

By moving latch **17*b* to a retracted position (identical to that shown in solid lines in FIG. 2), plate 5*b* and the swivel seat thereon may conveniently be removed from the carriage. This arrangement is advantageous in that it allows the seat to be easily transported from one place to another or stored during nonuse separate from guide rails 51 and carriage 53**.

While latching assemblies 1 and **1*a*** have been disclosed as being mounted on a boat thwart, it is to be understood that these assemblies are secureable on any flat surface and that their application is not to be limited by the specific disclosure herein.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A latching assembly for rigidly mounting a seat on a boat thwart or the like comprising a base adapted to rest on top of the thwart and to have the seat secured thereto, a pair of keepers adapted to be mounted on top of the thwart for securing opposite sides of the base to the thwart, at least one latch mounted on one of said opposite sides of the base, the latch being selectively movable from a retracted position to an extended latching position in which the latch projects beyond the respective side of the base and underlies one keeper thereby to prevent vertical movement of the base relative to the thwart, and means for locking the latch in its latching position, the end of the latch being adapted to abut its respective keeper to block side-to-side movement of the base on the thwart when the latch is locked in its latching position, and the sides of the latch being adapted to abut the keeper to block movement of the base on the thwart in a front-to-back and back-to-front direction when the latch is in its latching position.

2. A boat seat latching assembly as set forth in claim 1 wherein the side of the base opposite the latch is adapted to underlie the other keeper and to abut the keeper to block at that side of the base movement of the base on the thwart in said side-to-side, front-to-back and back-to-front directions when the latch is locked in its latching position.

3. A boat seat latching assembly as set forth in claim 2 wherein the side of the base opposite said latch has side walls adapted to extend upwardly at opposite sides of said other keeper and to abut the sides of said other keeper when the side of the base underlies said other keeper to block movement of the base on the thwart in said front-to-back and back-to-front directions.

4. A boat seat latching assembly as set forth in claim 1 wherein said latch is slidable on the base between said retracted and latching positions.

5. A boat seat latching assembly as set forth in claim 4 wherein said latch has abutment means thereon engageable with said one keeper to block movement of the base on the thwart in said front-to-back and back-to-front directions when the latch is in said latching position.

6. A boat seat latching assembly as set forth in claim 5 wherein said abutment means comprises a pair of vertical flanges along opposite sides of the latch adapted to extend upwardly at opposite sides of the other keeper and to abut the sides of said other keeper when the latch is in its latching position.

7. A boat seat latching assembly as set forth in claim 6 wherein said flanges have a pin-and-slot connection with the base.

8. A boat seat latching assembly as set forth in claim 7 wherein said base has side walls extending alongside and parallel to said flanges and said pin-and-slot connection comprises a slot in each of the walls and a pin means carried by the latch and extending through the slots, said slots each having horizontal and vertical portions with said pin means being adapted to move in the horizontal portions of the slots as the latch is slid from its retracted position to its latching position and to drop down into said vertical portions of the slots when the latch is in its latching position thereby automatically to lock the latch in its latching position.

9. A boat seat latching assembly as set forth in claim 8 wherein said flanges have openings therein generally corresponding in dimension to said vertical portions of said slots, said openings being adapted to move into alignment with the vertical portions of the slots when the latch is slid into its latching position whereupon said pin means is adapted to drop down in the aligned slots and openings thereby automatically to lock the latch in its latching position.

10. A boat seat latching assembly as set forth in claim 9 wherein said pin means comprises a rod extending between said flanges and through said slots and openings.

11. A boat seat latching assembly as set forth in claim 8 wherein said side walls are on the inside of said flanges and are connected to form a generally U-shaped member overlying said latch.

12. A boat seat latching assembly as set forth in claim 1 wherein said keepers are generally elongate plates having upwardly offset end margins for overlying said latch and said opposite side of the base.

13. A boat seat mounting assembly as set forth in claim 1 wherein said latch is swingably mounted on said base for swinging about a generally horizontal axis between said retracted and latching positions.

14. A boat seat latching assembly as set forth in claim 13 wherein said latch has abutment means thereon engageable with said one keeper to block said movement of the base on the thwart in said front-to-back and back-to-front directions when the latch is in said latching position.

15. A boat seat latching assembly as set forth in claim 14 wherein the base has side walls and said abutment means comprises a pair of vertical flanges along opposite sides of the latch, said flanges being pivoted for swinging movement at their upper ends to the walls and being adapted to extend upwardly at opposite sides of said one keeper and to abut the sides of the keeper when the latch is in its latching position.

16. A boat seat latching assembly as set forth in claim 15 wherein said side flanges have a pin-and-slot connection with said walls.

17. A boat seat latching assembly as set forth in claim 16 wherein said side walls extend alongside and parallel to said flanges and said pin-and-slot connection comprises a slot in each of the walls and a pin means carried by the latch and extending through the slots, said slots each having horizontal and vertical portions with said pin means being adapted to move in the horizonal portions of the slots as the latch is swung from its retracted position to its latching position and to drop down into said vertical portions of the slots when the latch is in its latching position thereby automatically to lock the latch in its latching position.

18. A boat seat latching assembly as set forth in claim 17 wherein said flanges have openings therein generally corresponding in dimension to said vertical portions of said slots, said openings being adapted to move into alignment with the vertical portions of the slots as the latch is swung into its latching position whereupon the pin means is adapted to drop down in the aligned slots and openings thereby automatically to lock the latch in its latching position.

19. A boat seat latching assembly as set forth in claim 18 wherein said pin means comprises a rod extending between said walls and through said slots and openings.

20. A boat seat latching assembly as set forth in claim 1 wherein said latch has a finger grip thereon for moving the latch between said retracted and latching positions.

21. A boat seat latching assembly as set forth in claim 1 wherein said latch is relatively long and flat and extends along substantially the entire side of the base, the latch being selectively movable outwardly in a direction perpendicular to its length from said retracted to said latching position in which the entire length of one edge of the latch projects beyond the side of the base and underlies said one keeper.

* * * * *